US010598027B2

(12) United States Patent
Bregman

(10) Patent No.: US 10,598,027 B2
(45) Date of Patent: Mar. 24, 2020

(54) BLADE FOR A GAS TURBINE AND METHOD OF COOLING THE BLADE

(71) Applicant: Siemens Aktiengesellschaft, Munich (DE)

(72) Inventor: Vitaly Bregman, Moscow (RU)

(73) Assignee: Siemens Aktiengesellschaft, Munich (DE)

( * ) Notice: Subject to any disclaimer, the term of this patent is extended or adjusted under 35 U.S.C. 154(b) by 469 days.

(21) Appl. No.: 15/129,461

(22) PCT Filed: Mar. 27, 2014

(86) PCT No.: PCT/RU2014/000200
§ 371 (c)(1),
(2) Date: Sep. 27, 2016

(87) PCT Pub. No.: WO2015/147672
PCT Pub. Date: Oct. 1, 2015

(65) Prior Publication Data

US 2017/0101872 A1 Apr. 13, 2017

(51) Int. Cl.
*F01D 5/18* (2006.01)
*F28F 3/04* (2006.01)
(Continued)

(52) U.S. Cl.
CPC ..... *F01D 5/187* (2013.01); *F28F 3/048* (2013.01); *F28F 13/08* (2013.01); *F01D 25/12* (2013.01); *F05D 2240/122* (2013.01); *F05D 2240/304* (2013.01); *F05D 2260/2214* (2013.01); *F05D 2260/22141* (2013.01)

(58) Field of Classification Search
CPC ..... F01D 5/187
See application file for complete search history.

(56) References Cited

U.S. PATENT DOCUMENTS 4,278,400 A 7/1981 Yamarik et al.
4,407,632 A * 10/1983 Liang ..... F01D 5/187 415/115

(Continued)

FOREIGN PATENT DOCUMENTS

EP 0 034 961 9/1981
EP 1 443 178 8/2004

(Continued)

*Primary Examiner* — Ninh H. Nguyen
*Assistant Examiner* — Behnoush Haghighian
(74) *Attorney, Agent, or Firm* — Cozen O'Connor

(57) ABSTRACT

A blade with an airfoil profile for a gas turbine includes at least two opposite walls enclosing the inner part of the blade which form cooling channels and method of cooling the blade with a reduced cooling fluid flow rate at a side towards the bottom part of the blade in comparison to the side at the top part, wherein the airfoil profile extends from a bottom to a top part of the blade and at least one direct cooling fluid inlet is arranged at the bottom part of the blade, where at least one set of ribs is respectively arranged on the two walls, extending from the respective wall into the inner part of the blade, forming cooling channels in-between ribs with a channel cross-section smaller at the side towards the bottom part of the blade compared to the side at the top part.

15 Claims, 1 Drawing Sheet

(51) Int. Cl.
*F28F 13/08* (2006.01)
*F01D 25/12* (2006.01)

(56) References Cited

U.S. PATENT DOCUMENTS 5,967,752 A * 10/1999 Lee ..... F01D 5/187 416/97 R
6,340,047 B1 * 1/2002 Frey ..... B22C 21/14 164/122.1
6,382,907 B1 * 5/2002 Bregman ..... F01D 5/187 415/115
6,773,231 B2 * 8/2004 Bunker ..... F01D 5/187 416/233
6,932,573 B2 * 8/2005 Liang ..... F01D 5/187 415/115
7,165,940 B2 * 1/2007 McGrath ..... F01D 5/187 416/1
7,435,053 B2 * 10/2008 Liang ..... F01D 5/187 416/97 R
7,467,922 B2 * 12/2008 Beeck ..... F01D 5/147 415/115
7,572,103 B2 * 8/2009 Walters ..... F01D 5/187 416/96 R
7,674,092 B2 * 3/2010 Annerfeldt ..... F01D 5/187 416/97 R
9,181,808 B2 * 11/2015 Carter ..... F01D 5/187
2004/0151586 A1 * 8/2004 Chlus ..... F01D 5/187 416/97 R
2005/0276697 A1 12/2005 McGrath et al.
2008/0085193 A1 * 4/2008 Liang ..... F01D 5/187 416/97 R
2013/0209268 A1 * 8/2013 Bregman ..... F01D 5/187 416/96 R
2013/0216395 A1 * 8/2013 Bregman ..... F01D 5/187 416/97 R
2014/0328669 A1 * 11/2014 Bregman ..... F01D 5/187 415/115

FOREIGN PATENT DOCUMENTS

EP 1 749 972 2/2007
WO WO 99/61756 12/1999
WO WO 2013/077761 5/2013

* cited by examiner

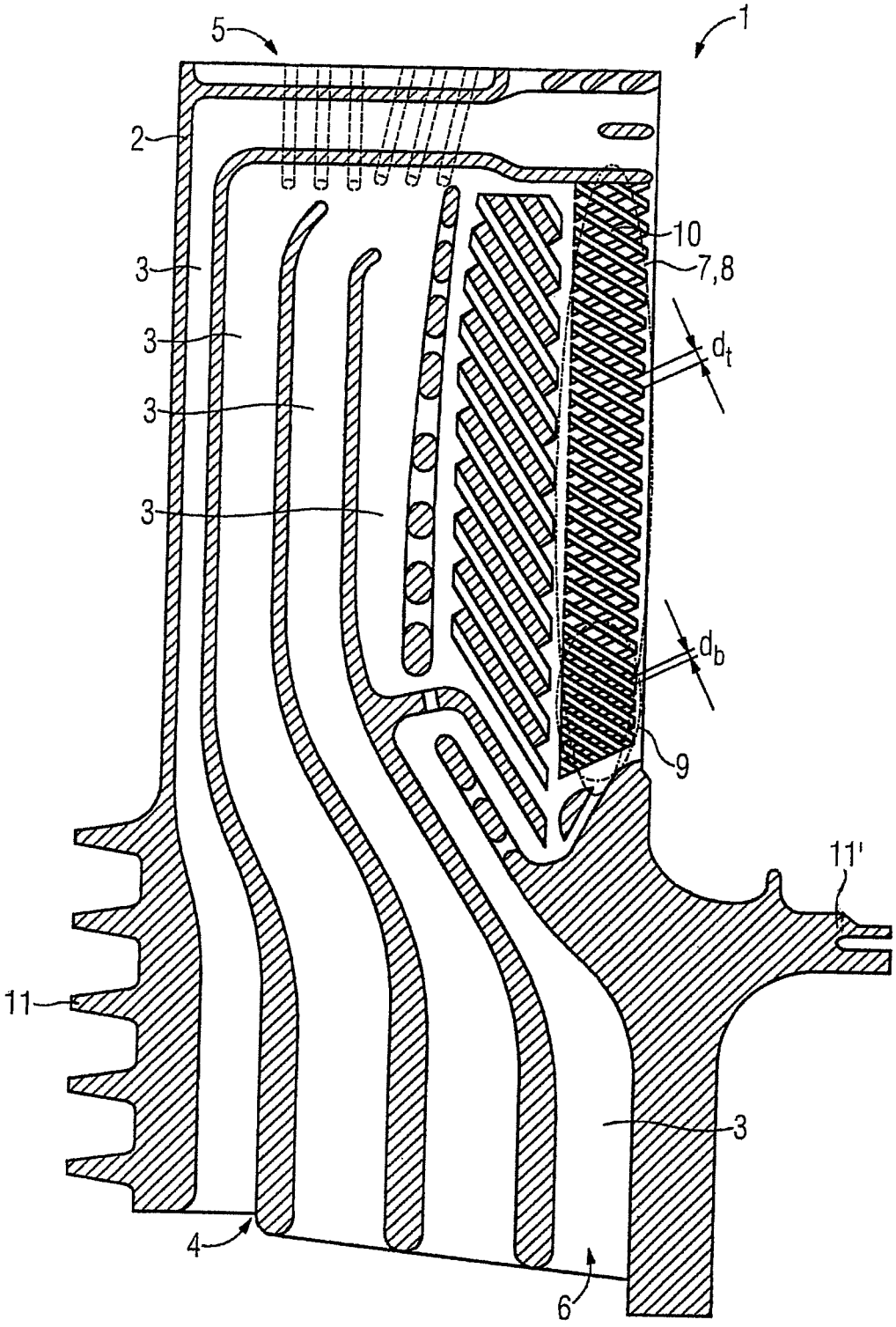
5
1
2
10
7,8
3
3
3
3
$d_t$
$d_b$
9
11'
11
3
4
6

BLADE FOR A GAS TURBINE AND METHOD OF COOLING THE BLADE

CROSS-REFERENCE TO RELATED APPLICATIONS

This is a U.S. national stage of application No. PCT/RU2014/000200 filed 27 Mar. 2014.

BACKGROUND OF THE INVENTION

1. Field of the Invention

The present invention relates to a method of cooling a blade and to a blade with an airfoil profile for a gas turbine, comprising at least two opposite walls enclosing the inner part of the blade comprising cooling channels. The airfoil profile is extending from a bottom to a top part of the blade and at least one direct cooling fluid inlet is arranged at the bottom part of the blade.

2. Description of the Related Art

Gas turbine blades with an airfoil profile are used to drive the rotation of a rotor shaft in a gas turbine. The blades are fixed to the shaft along a circumference next to each other and along a rotational axis in parallel planes, with planes being perpendicular to the rotor axis. An airfoil profile of the blade extends from a bottom to a top part of the blade, where the bottom part is the part that is fixed to the shaft. The blades are cooled, for example, by air as the cooling fluid. The cooling fluid flows through cooling channels within the blade, removing heat from the blade, particularly by transporting the heat transferred from the blade to and stored in the cooling fluid to the outside of the turbine.

Blades, which are also called vanes, are produced from two pieces, which are joined together to form a blade. Within the blade on every piece a set of ribs is located. The ribs of the two pieces are in parallel and the pieces are joined together congruent, giving channels by joining together the ribs of the opposite pieces. The ribs are arranged in parallel at every piece and the pieces are of a structure of opposite hand. The resulting cooling channels, formed in-between the ribs inside the blade, are mainly arranged parallel to the rotating axis with an inlet for cooling fluid on one side, a sucking side of the airfoil profile and an outlet at the other side of the profile. There is no direct feeding of cooling fluid at the bottom part of the blade.

The bottom part of the blade, especially at the trailing edge area of the airfoil, is very critical in terms of its thermal state and stress. An increase of cooling effectiveness in this area of the blade requires an increase of the cooling fluid mass flow. An increase in cooling fluid mass flow results in a drop of turbine efficiency.

EP 1895096 A1 discloses a way to improve the cooling effectiveness in the bottom part of the blade, which comprises a direct cooling fluid feeding for that part of the airfoil from a blade inlet in the bottom part. This can result in a sufficient cooling effectiveness of the bottom part. The design of cooling channels differs to the before described design, for example, by cooling channels not in parallel anymore to the axis of the rotator. With ribs on a piece arranged with equal distance to the neighboring ribs, all cooling channels have respectively the same width, i.e., cross section d. The cross section d is calculated according to a considerable hydraulic resistance for the cooling fluid and heat transfer. A direct cooling fluid feeding for the airfoil from a blade inlet in the bottom part exhibits in general a smaller hydraulic resistance and heat transfer from the blade to the cooling fluid. This can result in an outlet area of the ribs set which is too large, resulting in a too large cooling fluid mass flow, with disadvantages as described before. A solution is to place an orifice at the blade inlet in the bottom part to prevent too large values of mass flow of the cooling fluid in the bottom area of the blade. The orifice introduces an extra hydraulic resistance and pressure drop at the orifice, decreasing the cooling effectiveness, as compared with a maximal possible without orifice. For a sufficient level of cooling effectiveness in the bottom part, an additional cooling fluid mass flow is necessary. This results in a drop in the effectiveness of the turbine.

SUMMARY OF THE INVENTION

It is an object of the present invention to provide a blade with an airfoil profile for a gas turbine and a method of cooling the blade in a manner that prevents the above-described disadvantages. More particularly, it is an object of the invention to provide a blade and method to cool the blade with high effectiveness of cooling and minimal necessary cooling fluid mass flow, particularly in the bottom part of the blade, in combination with a high turbine effectiveness and/or efficiency.

These and other objects and advantages are achieved in accordance with the invention by a blade with an airfoil profile for a gas turbine and a method of cooling the blade, wherein the blade with an airfoil profile for a gas turbine in accordance with the present invention comprises at least two opposite walls enclosing the inner part of the blade comprising cooling channels. The airfoil profile extends from a bottom to a top part of the blade, with at least one direct cooling fluid inlet being arranged at the bottom part. On the two walls, at least one set of ribs is respectively arranged, extending from the respective wall into the inner part of the blade, and forming cooling channels in-between ribs with a channel cross-section $d_b$, $d_t$ smaller at the side towards the bottom part of the blade when compared to the side at the top part.

The different channel cross-sections $d_b$, $d_t$ enable a cooling fluid flow, which is reduced at the side towards the bottom part of the blade when compared to the side at the top part. An orifice at the blade inlet is not necessary. The cooling fluid mass flow is reduced in the bottom part of the blade by the smaller distance between ribs and the resulting smaller channel cross-sections $d_b$. The structure/assembling of ribs with smaller distances from each other in the bottom part than in the top part of the blade results in a high effectiveness of cooling and minimal necessary cooling fluid mass flow, particularly in the bottom part of the blade, and in a high turbine effectiveness and/or efficiency.

The ribs within a set of ribs can be arranged in parallel to each other, particularly with an orientation of the ribs of the first set of ribs that is different from the orientation of ribs of the at least one second set of ribs, which is attached to the opposite wall of the blade. The resulting structure gives a cooling channel structure with optimized cooling fluid flow. The ribs of one set of ribs on one wall superimposed over the second set of ribs on the other wall of the blade, arranged in the inner part of the blade, result in a grid structure with an orientation of the ribs of the first set of ribs that is different to the orientation of ribs of the at least one second set of ribs. The bottom part of the blade can comprise means to fix the blade to a rotor, particularly in the longitudinal direction of the airfoil profile perpendicular to a rotor axis. The cooling fluid is inserted into the blade from the bottom part of the blade, i.e., the part in contact to the rotor shaft. Corresponding cooling channels can be in the rotor shaft to supply the blade from the shaft with cooling fluid.

The fluid channels for the flow of a cooling fluid can be formed in-between neighboring ribs within a set of ribs, particularly with a fluid flow direction of the channels formed by the first set of ribs in a direction resulting from mirroring the fluid flow direction of the channel formed by the second set of ribs at an axis parallel to the rotor axis. The angle between superimposed ribs, and the angle of corresponding cooling channels, can be in the range between 10 and 80 degree, particularly in the range of 45 degree or smaller. The channel cross-section (d) of channels in-between ribs in a set of ribs can be continuous increasing along a perpendicular direction to the rotor axis from the bottom to the top part, comparing neighboring channels in a set of ribs. Alternatively the channel cross-section d of channels in-between ribs in a set of ribs can be increasing along a perpendicular direction to the rotor axis from the bottom to the top part with at least two values $d_b$, $d_t$, particularly with exactly two values $d_b$, $d_t$, the value $d_b$ at the side towards the bottom part and the value $d_t$ at the side towards the top part. Depending on the application, speed of rotor in use and heat production to be transferred, the increase in distance between neighboring ribs, i.e., the cooling channel cross-section d from the bottom to the top of the blade, can be chosen. The value of increase in distance is determined to optimize the cooling fluid flow within the blade and to optimize the heat transfer from the blade to the fluid.

The cross-section $d_b$ at the side towards the bottom part of the blade can be dimensioned in the range of approximately 1.5 mm and the cross-section $d_t$ at the side at the top part can be dimensioned in the range of approximately 2 mm. The values can be alternatively or additionally in the range of centimeters.

The at least one set of ribs can be arranged in a region next to an outlet of cooling fluid of the blade. The rib structure limits the fluid flow within the blade, in accordance with the hydraulic pressure within the blade and to the increasing distance between ribs from the bottom to the top of the blade. During rotation of the rotor, the top part rotates faster than the bottom part, resulting in different pressure conditions at the different parts. Depending on the pressure conditions at the blade, cooling fluid is sucked differently at different parts, and the different distances of ribs in the bottom part to the top part can optimize the fluid flow. A smaller fluid channel cross-section in the bottom part reduces the fluid flow in the bottom part, with more time for the fluid to interact with the blade material and increasing the heat transfer without increased mass flow of cooling fluid.

The cooling fluid can comprise or can be air. Other fluids such as oil, carbon hydride substances used for cooling, water or gases like nitrogen or oxygen, can also be used. Air is the most common cooling fluid used in gas turbine cooling.

It is also an object of the invention to provide a method of cooling the blade in accordance with the present invention, which comprises a reduced cooling fluid flow rate at the side towards the bottom part of the blade when compared to the side at the top part.

The method can further comprise, that the blade is assembled from at least two pieces, particularly casted pieces, with the at least one set of ribs extending from the wall of the first piece and a second set of ribs extending from the wall of the second piece, particularly assembling the two pieces in parallel with their outer shapes superimposed and/or with the at least two sets of ribs inside the blade covered by the walls of the two pieces.

The method can comprise arranging the at least two sets of ribs opposite to each other, forming a grid like structure.

The advantages in connection with the described method of cooling the blade according to the present invention are similar to the previously, in connection with the blade with an airfoil profile for a gas turbine described advantages and vice versa.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWING

The present invention is further described hereinafter with reference to an illustrated embodiment shown in the accompanying drawing, in which:

The FIGURE is an illustration of the blade in accordance with the invention.

DETAILED DESCRIPTION OF THE EXEMPLARY EMBODIMENTS

The FIG. shows a sectional view of a blade 1 in accordance with the present invention for a gas turbine with cooling fluid inlet 6 in the bottom part 4 and two sets of ribs 7, 8 forming cooling fluid channels with smaller cross-section d in the bottom part 4 than in the top part 5. In the FIG., a blade 1 in accordance with the present invention for a gas turbine with cooling fluid inlet 6 in the bottom part 4 is shown. The bottom part 4 is the part fixed to a rotor shaft of a turbine (not shown in the FIG. for simplicity). The blade 1 is assembled from at least two parts, comprising two walls 2, where particularly from every wall 2 a set of ribs 7, 8 extends into the inner space of the blade after assembly. In the FIG., only one wall 2 is shown, but with the two sets of ribs 7, 8 from both walls 2, in a sectional view of the blade 1. Cooling fluid, such as air, is pushed or sucked into the cooling channels 3 from the bottom part 4 of the blade 1. The fluid flows through the channels 3 to the sets of ribs 7, 8, which are located at the end of the channels 3. The set of ribs 7, 8 are arranged along one side of the airfoil inside the blade 1.

The ribs of a set of ribs 7, 8 are arranged in parallel, forming fluid channels in-between neighboring ribs with a cross-section d. In accordance with the present invention, the cross-section $d_b$ at the side towards the bottom part 9 is smaller than in other parts, especially the top part 10. In the bottom part 9, the cross-section $d_b$ is, for example, 1.5 mm and in the top part 10 the cross-section $d_t$ is, for example, 2 mm. A smaller cross-section d in the bottom part 4 reduces the cooling fluid flow in the bottom part 4, thus increasing the cooling effect in this area without the need to increase the mass flow of cooling fluid. A high level of efficiency of the turbine is preserved.

From a cooling fluid inlet, the direct cooling fluid inlet 6, cooling fluid directly flows to the two sets of ribs 7, 8, without flowing through the whole blade length. The cooling fluid entering by inlet 6 only flows within the lower, i.e., bottom part 4 of the blade 1, increasing the cooling efficiency in this region. The ribs at the side 9 towards the bottom part with cross-section d reduce the flow velocity when compared to ribs in other regions like the side 10 towards the top part with cross-section $d_t$.

Along the longitudinal side, the ribs of a set of ribs 7 are arranged in parallel with an angle to the rotor axis, for example, with an angle of 45 degree or less, for example, in the range of 20 degree. This results in cooling fluid channels with the same angle. The ribs of the set of ribs 8 on the opposite wall 2 are arranged the same way, but with an angle of, for example, −45 degree or less, such as in the range of −20 degree to the rotor axis. The interposition of the two sets of ribs 7, 8 result in a grid like structure arranged in a sandwich like manner between the two walls 2 of the blade 1.

Means 11, 11' to fix the blade 1 to the rotor shaft are arranged at the bottom part 4 of the blade 1. The cooling fluid inlets are arranged in-between the means 11, 11', especially the direct cooling fluid inlet 6 fluidically connected direct to the side towards the bottom part 9 with cross-section $d_b$. The means 11, 11' can be clamped, welded or otherwise fixed to the rotor shaft. The means 11, 11' are used to stably fix the blade 1 to the shaft, which is especially important for high rotation speeds of the rotor associated with high centrifugal forces applied to the blades 1.

The above described features of the embodiment in accordance with the present invention can be combined with embodiments known from the state of the art. For example, the form of the blade 1 can be different to the form shown in the FIG. The angles of the ribs on opposite walls 2 can differ in the mean value, giving an asymmetric grid structure, i.e., with a different form of space in-between the ribs in top view. One example is a set of ribs 7 with ribs all arranged in parallel to the rotor axis and a second set of ribs 8 with ribs arranged at an angle of 45 degree to the rotor axis. Other arrangements and angles are also possible. Instead of means 11, 11', the blade can be fixed to the rotor by screws or other fixation elements. The fluid channels 3 can have different forms when compared to the embodiment shown in the FIG.

A main advantage of the invention is a high efficiency of a turbine, with a high cooling level especially within the bottom part 4 of blades 1 without increasing the mass flow of cooling fluid. The difference in rib distance of neighboring ribs and resulting cooling channel cross-section d on the side 9 towards the bottom part 4 of the blade 1 in comparison to the side 10 towards the top part 5 of the blade enables an optimized cooling of the bottom part, without an increase of mass flow of fluid and/or the need to use orifices to reduce the flow in the bottom part, to improve heat transfer to the fluid from the blade and to improve the cooling effect.

While there have been shown, described and pointed out fundamental novel features of the invention as applied to a preferred embodiment thereof, it will be understood that various omissions and substitutions and changes in the form and details of the methods described and the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A blade with an airfoil profile for a gas turbine, comprising:

at least one direct cooling fluid inlet arranged at a bottom part of the blade, the bottom part of the blade being fixed to a rotor shaft of the gas turbine;

at least two opposite first and second walls enclosing an inner part of the blade and forming a plurality of cooling channels, the airfoil profile extending from the bottom part of the blade to a top part of the blade; and at least a first and a second set of ribs respectively arranged on the at least two opposite first and second walls, said at least the first and the second set of ribs being located at an end of the cooling channels, ribs within each first and second set of ribs being arranged in parallel to each other and along one side of the airfoil profile of the blade, and said at least the first and the second set of ribs extending from a respective wall of the at least two opposite first and second walls into the inner part of the blade;

wherein the ribs within the first set of ribs on the first wall are superimposed over the ribs of the second set of ribs on another second wall;

wherein cooling fluid channels are formed in-between the ribs of the first set of ribs and are also formed in-between the ribs of the second set of ribs;

wherein an orientation of the ribs of the first set of ribs is different than an orientation of ribs of the second set of ribs; and wherein a cross-section of the cooling fluid channels in-between neighboring ribs of the first set of ribs and a cross-section of the cooling fluid channels in-between neighboring ribs of the second set of ribs is smaller at a side oriented towards the bottom part of the blade in comparison to the side at the top part of the blade.

2. The blade according to claim 1, wherein the bottom part of the blade comprises means to affix the blade to a rotor in a longitudinal direction of the airfoil profile perpendicular to a rotor axis of the gas turbine.

3. The blade according to claim 2, further comprising:

fluid channels for flow of a cooling fluid channel formed in-between neighboring ribs within said at least the first and second set of ribs;

wherein a fluid flow direction of channels formed by the first set of ribs of said at least the first and the second set of ribs is in a direction opposite from the fluid flow direction of channels formed by a second set of ribs of said at least the first and set of ribs at an axis which extends parallel to the rotor axis.

4. The blade according to claim 2, wherein the cross-section of the cooling fluid channels in-between ribs in said at least the first and the second set of ribs continuously increases along a perpendicular direction to the rotor axis from the bottom of the blade to the top part of the blade, in comparison to neighboring cooling fluid channels in said at least the first and the second set of ribs.

5. The blade according to claim 2, wherein the cross-section of the cooling fluid channels in-between the ribs in said at least the first and the second set of ribs increases along a perpendicular direction to the rotor axis from the bottom to the top part of the blade by at least two values.

6. The blade according to claim 5, wherein the at least two values is exactly two values consisting of a value at the side towards the bottom part of the blade and a value at the side towards the top part of the blade.

7. The blade according to claim 1, wherein the cross-section in-between the ribs in said at least the first and the set of ribs at the side towards the bottom part of the blade is 1.5 mm and the cross-section in-between the ribs in said at least the first and the second set of ribs at the side at the top part of the blade is 2 mm.

8. The blade according to claim 1, wherein said at least the first and the second set of ribs is arranged adjacent an outlet of cooling fluid of the blade.

9. The blade according to claim 8, wherein the cooling fluid of the blade comprises one of air, oil a carbon hydride substance, water, nitrogen and oxygen.

10. The blade according to claim 2, wherein the means are fixable to the rotor shaft via clamping or welding.

11. The blade according claim 1, wherein the ribs within the first set of ribs are arranged with an angle to a rotor axis of the rotor shaft of 45 degrees or less, and the ribs within the second set of ribs are arranged with an angle to the rotor axis of the rotor shaft of −45 degrees or less; and wherein an angel between superimposed ribs of said at least the first and the second set of ribs and an angle of corresponding cooling fluid channels is in a range between 10 and 80 degrees.

12. The blade according claim 1, wherein the ribs of the first set of ribs are arranged with an angle to a rotor axis of the rotor shaft of 20 degrees, and the ribs of the second set of ribs are arranged with an angle to the rotor axis of the rotor shaft of −20 degrees.

13. The blade according to claim 1, wherein the cross-section of the cooling fluid channels formed by the first set of ribs and the cross-section of the cooling channels formed by the second set of ribs increases along a perpendicular direction to the rotor axis of the rotor shaft from the bottom part to the top part of the blade, wherein a value of the cross-section of the cooling fluid channels at the side oriented towards the bottom part is smaller than the value of the cross-section of the cooling fluid channels at the side towards the top part of the blade.

14. A gas turbine comprising a rotor with a rotor shaft and at least one blade as claimed in claim 1.

15. The gas turbine according to claim 14, wherein a bottom part of the at least one blade comprises means for affixing the at least one blade to the rotor shaft via clamping or welding.

* * * * *